US006792730B2

(12) United States Patent
Richardson

(10) Patent No.: US 6,792,730 B2
(45) Date of Patent: Sep. 21, 2004

(54) BUILDING ELEMENTS

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 43 days.

(21) Appl. No.: 09/742,639

(22) Filed: Dec. 21, 2000

(65) Prior Publication Data

US 2001/0005963 A1 Jul. 5, 2001

(30) Foreign Application Priority Data

Jan. 5, 2000 (GB) ..... 0000003

(51) Int. Cl.[7] ..... E04D 3/362; E04D 3/32

(52) U.S. Cl. ..... 52/586.2; 52/461

(58) Field of Search ..... 52/461, 464, 468, 52/470, 471, 580, 562.1, 586.2, 762, 775, 779

(56) References Cited

U.S. PATENT DOCUMENTS

| | | | | | |
|---|---|---|---|---|---|
| 2,017,441 | A | * | 10/1935 | Kotrbaty | 52/733.4 |
| 2,106,179 | A | * | 1/1938 | Kotrbaty | 52/354 |
| 3,363,381 | A | * | 1/1968 | Forrest | |
| 3,512,819 | A | * | 5/1970 | Morgan et al. | 52/461 |
| 3,640,039 | A | * | 2/1972 | McKee et al. | 52/281 |
| 3,685,222 | A | * | 8/1972 | Curtess | 52/92.2 |
| 3,820,299 | A | * | 6/1974 | Verholt | 52/282.2 |
| 4,557,091 | A | * | 12/1985 | Auer | 52/282.3 |
| 4,573,300 | A | | 3/1986 | Bezner | |
| 4,730,428 | A | * | 3/1988 | Head et al. | |
| 4,790,112 | A | * | 12/1988 | Wang | |
| 4,998,395 | A | * | 3/1991 | Bezner | |
| 5,014,478 | A | * | 5/1991 | Spring | 52/281 |
| 5,062,250 | A | * | 11/1991 | Buzzella | |
| 5,580,620 | A | * | 12/1996 | Campbell et al. | 428/34 |
| 5,706,620 | A | * | 1/1998 | De Zen | 52/220.2 |
| 5,966,888 | A | | 10/1999 | Richardson | |
| 5,996,301 | A | * | 12/1999 | Conterno | |
| 6,016,632 | A | * | 1/2000 | McGee et al. | |
| RE36,976 | E | | 12/2000 | Bezner | |
| 6,161,356 | A | * | 12/2000 | Richardson | 52/586.2 |
| 6,164,024 | A | * | 12/2000 | Konstantin | |
| 6,202,382 | B1 | * | 3/2001 | Conterno | |
| 6,298,627 | B1 | * | 10/2001 | Richardson | |
| 6,405,504 | B1 | * | 6/2002 | Richardson | |
| 6,536,175 | B2 | * | 3/2003 | Conterno | |

FOREIGN PATENT DOCUMENTS

| | | | | |
|---|---|---|---|---|
| EP | 0050462 | * | 4/1982 | E04C/2/54 |
| EP | 790368 | A | 8/1997 | |
| EP | 0835968 | * | 4/1998 | E04D/3/28 |
| GB | 1511189 | | 5/1978 | |
| GB | 1528874 | | 10/1978 | |
| GB | 2147334 | A | 5/1985 | |
| GB | 2268765 | A | 1/1994 | |
| GB | 2 269 833 | A | 2/1994 | |
| GB | 2318133 | A | 4/1998 | |
| GB | 2329402 | * | 3/1999 | E04D/3/363 |
| GB | 2344118 | A | 5/2000 | |

* cited by examiner

*Primary Examiner*—Robert Canfield
(74) *Attorney, Agent, or Firm*—Wood, Phillips, Katz, Clark & Mortimer

(57) ABSTRACT

A hollow building element (10) of plastics material comprises one of more longitudinal ducts (30) and has, at opposite sides thereof, coupling members (32,34), whereby elements are connected together directly or indirectly, wherein an upper coupling member at one side of an element is a hook like member and an upper coupling member at the opposite side of the element include a latch for the hook-like member of another like element. Building structures are created by connecting together such building elements.

3 Claims, 3 Drawing Sheets

BUILDING ELEMENTS

This invention concerns building elements for making building structures and building structures made from such elements.

Self supporting roofs or roof sections are known which comprise a plurality of extruded plastics profile elements connected side by side, each element having at least one longitudinal chamber or duct and coupling members, whereby neighboring profile elements are coupled, the adjacent coupling members of neighboring elements engaging to form ducts.

In GB1528874, the coupling members of adjacent elements form together a duct through which is inserted an elongate locking member, the locking member having at least two opposite longitudinal edges that are a slide fit within the duct, so as to prevent the locking member from twisting under load.

In GB 1511189, it was further proposed that the longitudinal duct, of each element have an internal partition substantially parallel to the outer surfaces of a building structure made up of elements. The partition was principally to provide additional heat insulation, Further proposals for such profile elements have been made in EP0709368A, in which multiple duct elements have main ducts and intermediate secondary ducts having internal partitions that are in line. Connections of these elements together is as disclosed in GB1511189 and GB1528874.

A yet further proposal for such profile elements was made in GB2147334A, in which upper coupling members consist of cylindrical, slotted downwardly open flanges of such dimension that a flange of a first element can be snap-locked into a flange of a second identical element. In addition, the lower end of one side wall of an element is integrally connected to a guide member which is adapted to engage the anchoring member of an adjacent element so as to maintain the lower ends of two adjacent side walls interspaced relationship so as to form a tight connection between such elements.

In our own GB22687665A, we proposed a hollow building element of plastics material comprising a plurality of hollow ducts in two layers and having at opposite sides thereof coupling members whereby elements are connected to each other, upper coupling members comprising a part engageable with a stiffening or reinforcing beam between the adjacent elements.

In our subsequent GB2318133A, we proposed a hollow building element of plastics material comprising one or more longitudinal ducts and having, at opposite sides thereof, coupling members whereby elements are connected to each other directly or indirectly, wherein lower coupling members comprise ducted flanges to provide an insulation barrier.

Problems with the type of elements described above and structures made there from arise in the two areas. The first lies in the formation of cold spots causing condensation within or between the elements. Cold spots are formed where elements are coupled together, because aluminum stiffening beams used to reinforce and in some cases hold elements together are in contact with single layers of plastics material forming coupling flanges providing a oath for heat loss by conduction.

The second problem lies in dealing with water collecting between elements either huge condensation or rainwater ingress. If water remains within the space between elements, it can be unsightly from below as well as causing corrosion.

The object of this invention is to provide improved coupling of plastics profile building elements.

According to a first aspect of this invention there is provided a hollow building element of plastics material comprising one or more longitudinal ducts and having, at opposite sides thereof, coupling members, whereby elements are connected together directly or indirectly, wherein an upper coupling member at one side of an element is a hook like member and an upper coupling member at the opposite side of the element includes a latch for the hook-like member of another like element.

This aspect of the invention further provides a building structure, such as a roof comprising two or more hollow building elements connected side by side with a reinforcing beam between the elements, the hollow building elements comprising one or more longitudinal ducts and having at opposite sides thereof, coupling members, whereby the elements are connected together wherein an upper coupling member at one side of an element is a hook like member and an upper coupling member at the opposite side of the element includes a latch for the hook like member of another element.

The upper coupling member that includes a latch may be in the form of a longitudinal duct for receiving the reinforcing beam. Latching formations may be provided on one or opposite sides of the duct with a corresponding cooperating formation on the hook like coupling member.

The latching member may be an upstanding formation at one side of an element over which the hook like coupling member latches with a reinforcing beam between the sides of the adjacent elements.

According to a second aspect of the invention there is provided a hollow building element of plastics material comprising one or more longitudinal ducts and having at opposite sides thereof, coupling members, whereby elements are connected together directly or indirectly, wherein upper and lower coupling members have one or more ducts therethrough.

This aspect of the invention further provides a building structure, such as a roof, comprising two or more hollow building elements connected side by side with a reinforcing beam between the elements, the hollow building elements comprising one or more longitudinal ducts and having, at opposite sides thereof, coupling members whereby elements are coupled together directly or indirectly, the upper and lower coupling members having one or more ducts therethrough.

According to a third aspect of the invention there is provided a hollow building element of plastics material comprising one or more longitudinal ducts and having, at opposite sides thereof, coupling members, whereby elements are connected together directly or indirectly, wherein upper coupling members for engagement with a reinforcing beam between adjacent elements include upwardly open channels for drainage purposes.

This aspect of the invention further provides a building structure, such as a roof comprising two or more hollow building elements connected side by side with a reinforcing beam between the elements, the hollow building elements comprising one or more longitudinal ducts and having, at opposite sides thereof, coupling members whereby elements are connected together directly or indirectly wherein upper coupling members engaging the reinforcing beam include upwardly open channels for drainage purposes.

Preferably the upper coupling members of this aspect of the invention have a downwardly extending part to locate in a channel of the reinforcing beam and an upwardly extending part to form a side of a drainage channel.

According to a fourth aspect of the invention there, is provided a hollow building element of plastics material comprising one or more longitudinal ducts and having at opposite sides thereof coupling members whereby elements are connected together directly or indirectly, wherein at one side the elements have a pocket for receiving and retaining a reinforcing beam.

This aspect of the invention further provides a building structure such as a roof, comprising two or more hollow building elements connected side by side with a reinforcing beam between elements, the hollow building elements comprising one or more longitudinal ducts and having, at opposite sides thereof, coupling members whereby elements are connected together directly or indirectly, wherein at one side the elements have a pocket for receiving and retaining the reinforcing beam.

Preferably outer sides of the pockets include formations to fit complementary formations of adjacent elements. Typically opposite sides of each element will have oppositely orientated L-shaped flanges shaped to fit together.

According to the fifth aspect of the invention there is provided a hollow building element of plastics material comprising one or more longitudinal ducts and having, at opposite sides thereof, coupling members, whereby elements are connected to each other directly or indirectly, wherein upper coupling members at opposite sides of the element are slidably engageable with cooperating formations of a reinforcing beam between the elements.

This aspect of the invention further provides a building structure, such as a roof, comprising two or more hollow building elements connected side by side with a reinforcing beam between the elements, the hollow building elements comprising one or more longitudinal ducts and having, at opposite sides thereof, coupling members, whereby the elements are connected directly or indirectly, wherein upper coupling members at opposite sides of the elements are slidably engaged with cooperating formations of the reinforcing beam. One of the building element and the reinforcing beam preferably has a T-slot and the other a T-section protrusion that is slidably engageable in the T-slot.

In prior art building structures, the elements and reinforcing beams have hook-like engaging components, so that some movement of an element relative to the beam is possible during insertion of securing screws. By providing sliding inter fitment between the upper coupling members and the reinforcing bar, there is less scope for relative movement between the elements and the reinforcing bar and hence between adjacent elements.

According to a sixth aspect of this invention there is provided a hollow building element of plastics material comprising one or more longitudinal ducts and having, at opposite sides thereof, coupling members, whereby elements are connected to each other directly or indirectly, wherein upper coupling members comprise upstands adapted for location thereon of a capping being formed as a hollow profile member having a plurality of longitudinal ducts.

This aspect of the invention further provides a building structure, such as a roof, comprising two or more hollow building elements connected side by side with a reinforcing beam: between the elements, the hollow building elements comprising one or mare longitudinal ducts and having, at opposite sides thereof, coupling members, whereby elements are connected to each other directly or indirectly, wherein upper coupling members comprise, upstands adapted for location thereon of capping to hold adjacent elements together, the capping being formed as a hollow profile member having a plurality of longitudinal ducts.

This invention will now be further described, by way of example only, with reference to the accompanying drawings, in which.

Figure 1:
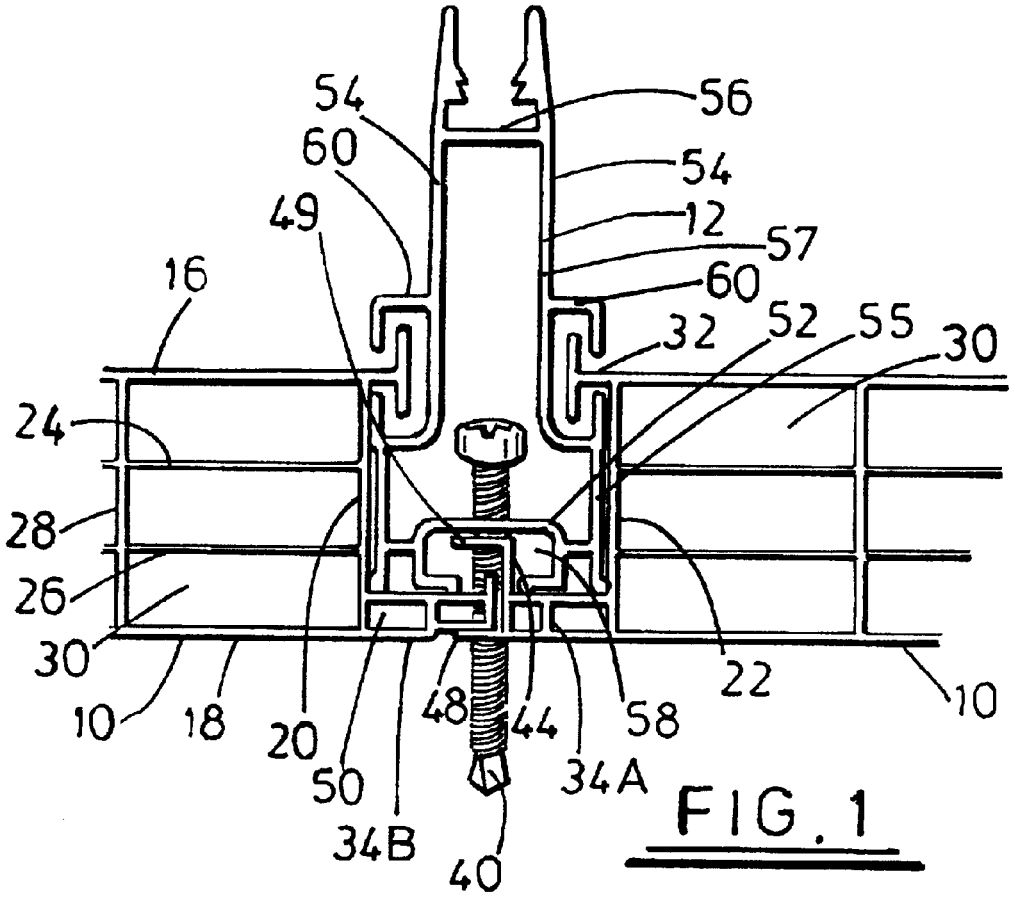
FIG. 1 is an end view of part of a first building structure according to the invention.

Referring to FIG. 1 of the accompanying drawings, a building structure, such as a conservatory roof, comprises building panels 10 of plastics material, such as of polycarbonate, connected side by side to and by means of aluminum reinforcing beams 12. The connection of adjacent panels 10 is sealed by a capping (not shown) pressed onto the beam 12.

The building panels 10 are hollow and have flat top and bottom walls 16, respectively, end walls 20, 22, intermediate walls 24, 26 parallel to the top and bottom walls and intermediate walls 28 parallel to the end walls, thereby forming ducts 30 through the panels in three rows on top of each other. The intermediate walls 24, 26 and 28 are generally thinner than the outer walls of the panels.

At the ends of the panels 10 are upper and lower coupling members 32, 34A/34B respectively. Each upper coupling member 32 conforms to a T-section, as shown, and has an upper flange, which projects upwardly above the flat top surface 16 of the panel 10 having said upper coupling member 32, and a lower flange, which projects downwardly. The upper coupling members 32 are the same at each end of each of the panels 10, whereas the lower coupling members 34A at one end of each of the panels 10 are different when compared to the coupling members 34B at the opposite ends of the panels 10.

The lower coupling member 34A comprises a ducted flange extending front the end wall of the panel and terminating with a square C-section part 44 forming a horizontal channel with a bottom wall 48 and a top wall 49, the channel being of greater height than the flange. The lower coupling member 34B comprises a ducted flange 50 extending from the opposite end wall of the panel to the coupling member 34A. The flange has its bottom edge stepped upwards at its free end to accommodate bottom wall 4B of the coupling member 34A, when two adjacent panels are brought together. Between the abutting vertical faces of the lower coupling members 34A and B a strip of sealing tape (not shown) is fixed to reduce risk of condensation formation in the space between adjacent panels 10.

The reinforcing beam 12 is formed as a hollow extension and has a base 52, sides 54 and a top 56. The sides extend upwardly for a first part 55 before converging towards the top 56 for second part 67. The base 52 is formed with a channel 58 therealong with rebated sides in order to accommodate top wall 49 of a coupling member 34A.

Where the first and second beam parts 55 and 57 meet, the beam has along opposite outer sides T-section channel slots 60 that are shaped to receive slidingly T-section upper coupling members 32. Screws 40 through the base of the beam 12 and the lower coupling members are used to secure the panels 10 to an underlying support structure (not shown), such as an eaves beam.

Figure 2:
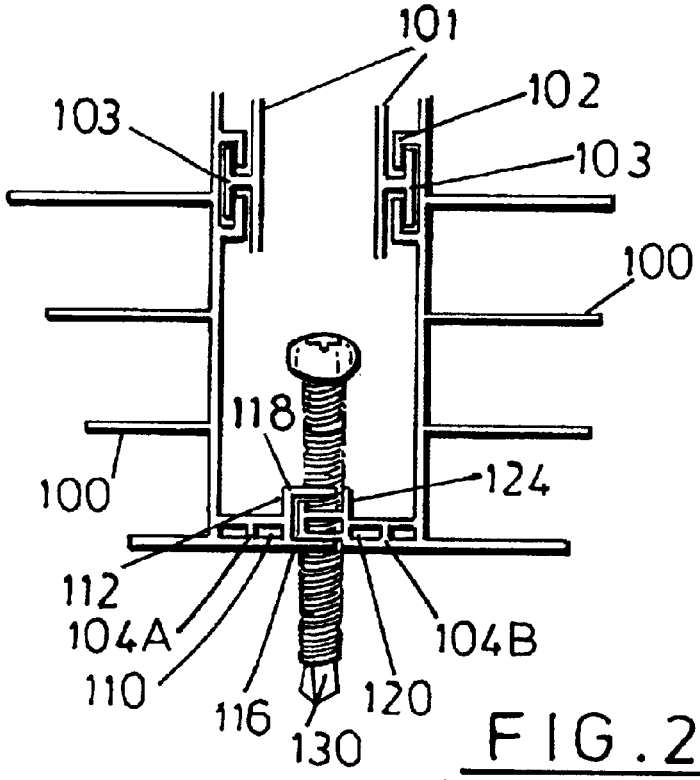
FIG. 2 is an end view of part of a second building structure according to the invention.

Turning to FIG. 2 of the accompanying drawings, hollow building panels 100, of the same general type as panel 10 of FIG. 1, each having a flat top surface, are connected together side by side and by means of a reinforcing beam 101 (shown partially) of the same general type as reinforcing beam 12 of FIG. 1. The connection of adjacent panels 100 is sealed by a capping (not shown) pressed onto the beam 101. The building panels 100 have upper and lower coupling members 102,104A/104B respectively, at their ends. The upper coupling members 102 are in the form of T-section slots along the panel end walls and the reinforcing beam 101 has on opposite sides T-section flanges that are slidingly retained in the T-section slots. A portion of each upper coupling member 102 extends upwardly above the flat top surface of the panel 100 said upper coupling member 102.

The lower coupling members 104 are different at opposite ends of the panels. The lower coupling member 104A comprises a ducted flange 110 extending from the end wall of the panel and terminating in a square C-section part 112 forming a horizontal channel with a bottom wail 116 and a top wall 118, the channel being of greater height that the flange. The flange has two ducts of substantially the same size.

The lower coupling member 104B comprises a ducted flange 120 extending from the opposite end wall of a panel to the coupling member 104A. The flange 120 has three ducts substantially the same width as those of the flange 110. The flange 120 has its bottom edge stepped upwards at its free end to accommodate bottom wall 116 of coupling member 104A when two panels are brought together as shown. The flange 120 also has an upstand 124 which is a continuation of the inner wall of the outermost duct of the flange 120.

The lower coupling member is sized so that its outermost duct lies more or less centrally between the end walls of the adjacent to panels, so that fixing screw 130 can be screwed through that duct rather than between coupling members. Furthermore, the screw 130 also goes through the bottom and top walls of the part 112, so that there is no pushing apart of the panels as the screw is fitted nor damage to sealing tape between abutting vertical faces of the lower coupling members.

To construct a roof using building panels 10 or 100, the panels are laid side-by-side on a structure providing support at opposite ends of the panels with the lower coupling members 34A and B or 104A and B engaged, sealing tape having been affixed between the abutting vertical faces of the lower coupling members. A beam 12 or 101 is then slid into the space between the panels to hold the lower coupling members together and to engage the upper coupling members. Then a screw is secured through the beam and coupling members into an underlying supporting structural component. Finally, a capping is pressed onto the beam until it seats onto the panels and is engaged on the head of the beam.

Figures 3, 4, 5:
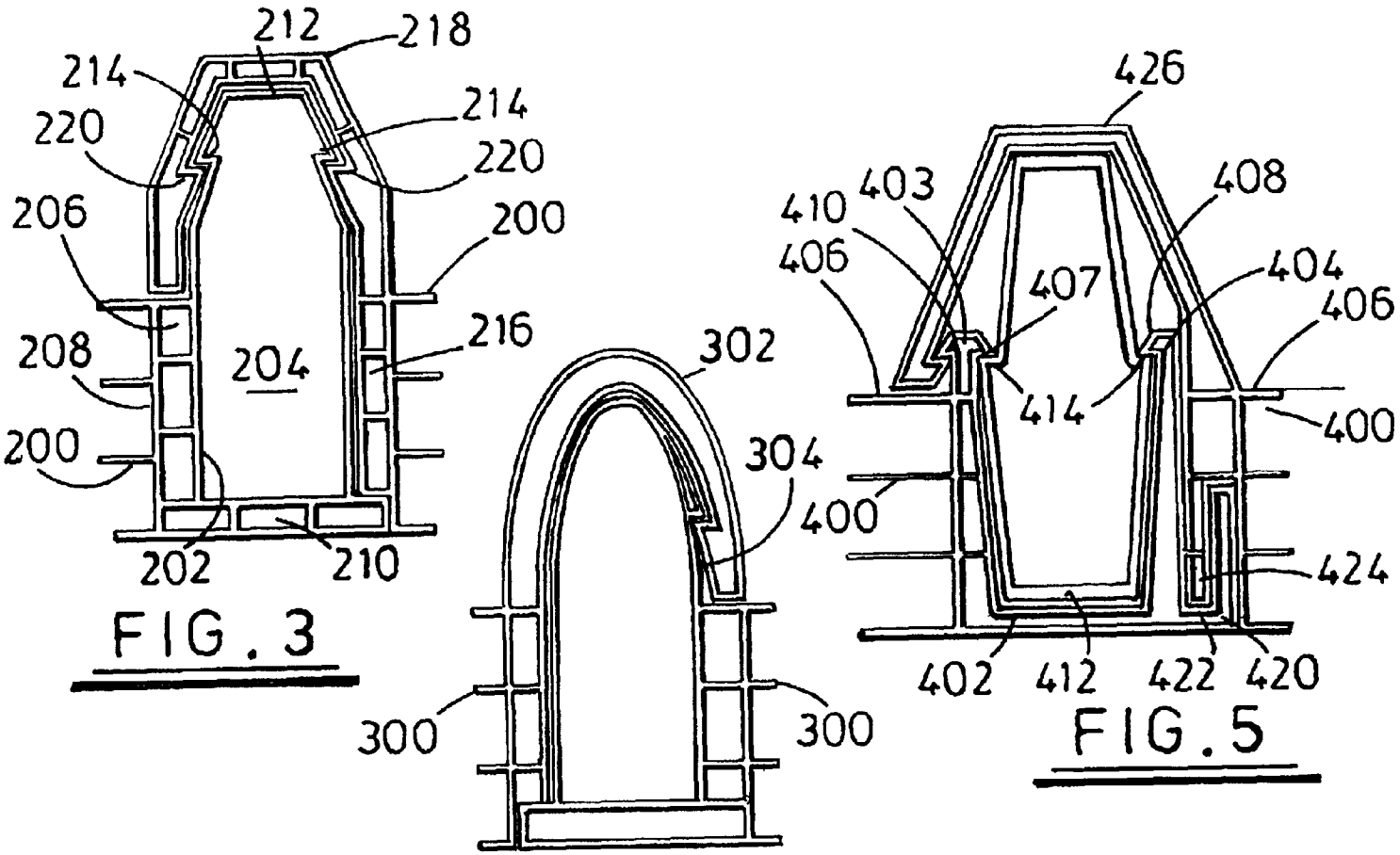
FIG. 3 is an end view of part of a third building structure according to the invention.
FIG. 4 is an end view of part of a fourth building structure according to the invention.
FIG. 5 is an end view of part of a fifth building structure according to invention.

Turning to FIG. 3 of the accompanying drawings, there is shown a variation on the panels of FIGS. 1 and 2 regarding their coupling together. Panels 200 have at one end a coupling member 202 in the form of hollow duct 204 shaped to receive a reinforcing beam of similar cross-sectional shape. The duct 204 is bounded on one side by a ducted strip 206 between the duct and the panel end wall 208 end along its base by a second ducted strip 210 that extends beyond the duct 204. The duct 204 has a top part 212 that is stepped along opposite sides at 214.

The opposite end of the panels has a ducted strip 216, which stands above the bottom wall of the panel a distance corresponding to the thickness of the extension of the ducted strip 210. The ducted strip 216 continues above the top wall of the panel to form a hook like coupling member 218 that is notched on opposite in side fares at 220. The member 218 acts as a capping for the coupling together of panels, the notches 220 enabling the coupling member 218 to be a snap-fit over the steps 214 on the sides of the duct 204 with the bottom of ducted strip 216 seated on the extension of ducted strip 210 of the other panel. The capping 218, being ducted, can provide improved thermal insulation.

This arrangement simplifies construction of a roof from such panels because there is no reliance on a reinforcing beam for holding the panels together and no separate capping. Furthermore, the variously dusted parts at each end of the panels improve insulation properties for the roof.

FIG. 4 of the accompanying drawings shows a variation on the arrangement of FIG. 3, wherein hook-like coupling member 302 at one end of panel 300 has an arched shape rather than an angular shape and snap-fits onto one side of duct 304 of the other panel 300. Furthermore base 306 of duct 304 is formed as a single duct rather than as three ducts. The coupling member 302 is twin-walled and may provide improved thermal insulation.

FIG. 5 of the accompanying drawings continue s the hook-like coupling theme of one panel end over a formation of the adjacent panel end. Panels 400 have at one end a trough 402 which extends at both sides 403, 404 above the panel top wall 406. The trough side extensions 403, 404 both have inwards facing lips 407, 408 respectively and the extension 403 has a lip 410 on its opposite side. The lips 407, 408 are to assist with retention of a hallow reinforcing beam 412 which is stepped along its sides at 414 for that purpose. With this arrangement it is possible to push the reinforcing beam into the trough rather than having to slide it into position as with prior art arrangement. The reinforcing beams may even be supplied to site already in place the each panel. Extending further outwards from the trough base is an L-shaped flange 420 forming a slot 422 between it and the trough side wall.

The other end of panels 400 have an inverted L-section member 424 that fits the slot 422 of an adjacent panel and a twin-walled, hook-like coupling member 426 shaped to snap-fit over the lip 410. The member 426 acts as a capping and being twin-walled can improve thermal performance of a roof made from panels 400.

Figure 6:
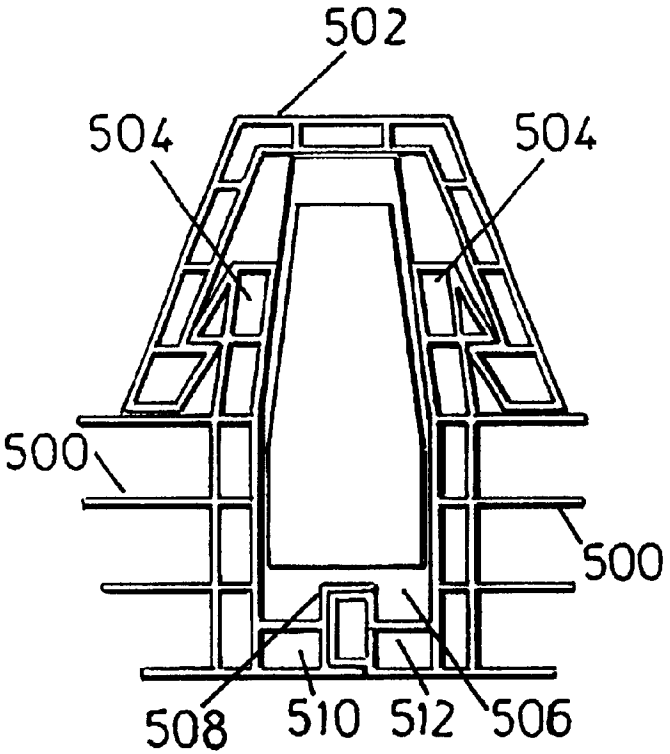
FIG. 6 is an end view of part of a sixth building structure according to the invention.

In FIG. 6 of the accompanying drawings, panels 500, again of the same general type as shown in FIG. 1 of the drawings have ducted capping 502 to hold panels together at the top by snap-fitting over upwardly extending ducted strips 504 at panel ends. The panels are held together at the bottom by reinforcing beams 506 that has a longitudinally slotted base 508 that sits over and holds together abutting lower coupling members 510 and 512 in a similar fashion to that shown in FIG. 2 of the drawings.

The ducted or twin-walled capping 502 helps improve thermal performance of a roof made from panels 500.

Figure 7:
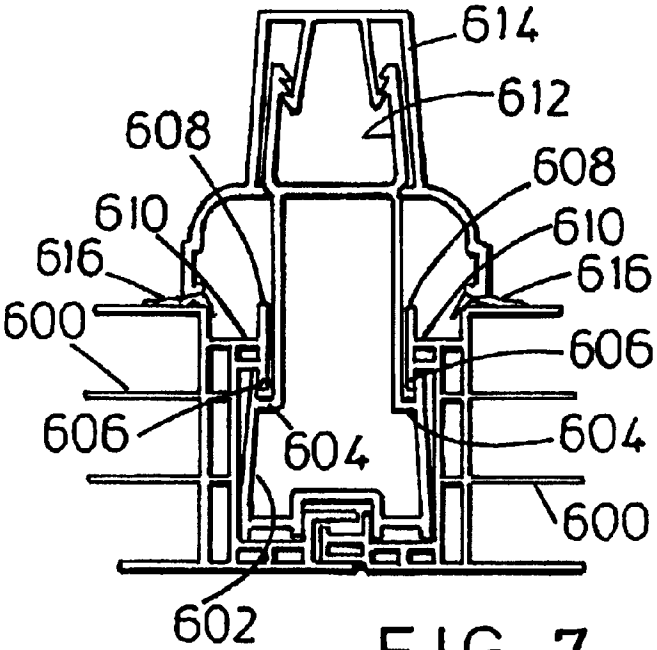
FIG. 7 is an end view of part of a seventh building structure according to the invention.

Finally, the embodiment of FIG. 7 shows panels 600 coupled together at the bottom by a similar arrangement to that shown in FIGS. 2 and 6 of the drawings. The upper coupling of the panels is via reinforcing beam 602 that has channels 604 along opposite sides to receive and retain corresponding shaped flanges 606 along panel ends.

The flanges 606 extend from the panel end walls from below the top walls of the panels and have upwards webs 608 forming secondary drainage troughs 610. There are no parts of the coupling members of the panels 600 extending above or below the top and bottom walls of the panels. An advantage of this is that no transverse components of a roof made with these panels need to be notched to accommodate any part of the coupling members. That saves time and hence can reduce cost compared to using panels whose coupling members do extend above or below top and bottom panel walls.

The reinforcing beams 602 has a top formation 612 to receive a capping 614 in a snap-fit manner and edges of the capping include sealing strips 616 to seal between the capping edges and the panel top walls.

What is claimed is:

1. In a building structure comprising two building elements and a reinforcing beam between the building elements, the reinforcing beam having two sides, each of which has a coupling formation, each building element having a side facing the reinforcing beam, each building element having a coupling formation on the side facing the reinforcing beam, wherein, on each side of the reinforcing beam, one of the building element coupling formations and one of the reinforcing beam coupling formations are engaged slidably, an improvement wherein, on each side of the reinforcing beam, one of the slidably engaged coupling formations has a T-section slot and the other of the slidably engaged coupling formations has T-section flanges, which are seated in the T-section slot, and wherein, on each side of the reinforcing beam, each building element has a flat top surface, above which a portion of each coupling formation of said building element projects upwardly.

2. The improvement of claim 1 wherein the reinforcing beam coupling formations have the T-section slots and wherein the building element coupling formations have the T-section flanges.

3. The improvement of claim 1 wherein the reinforcing beam coupling formations have the T-section flanges and wherein the building element coupling formations have the T-section slots.

* * * * *